US005644280A

United States Patent [19]

Wilson et al.

[11] Patent Number: 5,644,280

[45] Date of Patent: Jul. 1, 1997

[54] METHOD OF OPERATING A TWO-COIL SOLENOID VALVE

[75] Inventors: Colin John Wilson, Hertfordshire; David Roy Withers, Cambridgeshire; Ewan Stuart Bewley, London, all of Great Britain

[73] Assignee: Perkins Limited, Cambridgeshire, United Kingdom

[21] Appl. No.: 362,265

[22] Filed: Dec. 22, 1994

[30] Foreign Application Priority Data

Dec. 23, 1993 [GB] United Kingdom ..... 9326245

[51] Int. Cl.[6] ..... H01F 3/00

[52] U.S. Cl. ..... 335/256; 335/266; 251/129.1

[58] Field of Search ..... 335/256, 266, 335/268; 251/54, 129.1, 129.16

[56] References Cited

U.S. PATENT DOCUMENTS

| | | | |
|---|---|---|---|
| 3,178,151 | 4/1965 | Caldwell | 335/256 |
| 3,503,022 | 3/1970 | Burdett | 335/256 |
| 4,422,060 | 12/1983 | Matsumoto et al. | 335/256 |
| 5,080,323 | 1/1992 | Kreuter | 335/256 |
| 5,223,812 | 6/1993 | Kreuter | 335/256 |

FOREIGN PATENT DOCUMENTS 2189940 11/1987 United Kingdom .

*Primary Examiner*—Lincoln Donovan
*Attorney, Agent, or Firm*—Nilles & Nilles, S.C.

[57] ABSTRACT

A method of operating a two-coil solenoid valve of the type including an armature member located in a housing for movement between a first electromagnet and a second electromagnet, each electromagnet being located adjacent to a respective end of the armature member and being switchable between an on state and an off state. In order to move the armature member from a first position closely adjacent to the first electromagnet to a second position closely adjacent to the second electromagnet, the electromagnets are controlled to be at the same initial switched state and subsequently one of the electromagnets is switched to the other switched state for a first predetermined period sufficient to allow the resultant pull exerted on the armature member to be such that the armature member is caused to move towards the second electromagnet. The duration of the first predetermined period is such that the one electromagnet is switched back to its initial switched state before the armature member reaches the second position.

17 Claims, 6 Drawing Sheets

METHOD OF OPERATING A TWO-COIL SOLENOID VALVE

FIELD OF THE INVENTION

The present invention relates to a method of operating a two-coil solenoid valve.

BACKGROUND OF THE INVENTION

A two-coil solenoid device comprising a cylindrical metallic armature mounted within a housing for axial movement between a first electromagnet and a second electromagnet, each located at a respective end of the housing adjacent to a respective end of the armature, is known from GB 2189940A.

Movement of the armature from closely adjacent to the first electromagnet to closely adjacent to the second electromagnet is achieved by switching on both electromagnets and subsequently switching off the first electromagnet. Subsequent to this, the second electromagnet may be switched off. The armature can be made to move in an opposite direction by again switching on both the electromagnets and subsequently switching off the second electromagnet.

One disadvantage of this method of controlling armature movement is the existence of dead-time between switching on the electromagnets and their reaching steady state current flow through their coils.

Another disadvantage is the increased consumption of power and resultant heat build-up in the device due to the electromagnets being switched on for overlapping periods.

It is an object of the present invention to provide an improved method of operating a two-coil solenoid valve (TCV).

According to a first aspect of the present invention, there is provided a method of operating a two-coil solenoid valve of the type comprising an armature member located in a housing for movement between a first electromagnet and a second electromagnet, each electromagnet being located adjacent to a respective end of said armature member and being switchable between an on state and an off state, wherein, to move the armature member from a first position closely adjacent to the first electromagnet to a second position closely adjacent to the second electromagnet, the electromagnets are controlled to be at the same initial switched state and subsequently one of said electromagnets is switched to said other switched state for a first predetermined period sufficient to allow the resultant pull exerted on the armature member to be such that the armature member is caused to move towards the second electromagnet, the duration of the first predetermined period being such that said one electromagnet is switched back to its initial switched state before the armature member reaches said second position.

The method may be such that the electromagnets are controlled to be initially at their switched on states prior to being controlled to cause movement of the armature member.

The method may also be such that, after the armature member has reached the second position, the second electromagnet is controlled to be switched to its off state for a second predetermined period, the duration of this period being such that a steady state current flowing in a coil of the second electromagnet decreases to a lower steady state current level which is sufficient to maintain the armature member in said second position prior to a subsequent further switching off of the second electromagnet for a further predetermined period to cause movement of the armature member to the first position.

Alternatively, the method may be such that the electromagnets are controlled to be initially at their switched off states prior to being controlled to cause movement of the armature member.

The method may be used to operate a two-coil solenoid valve in which the armature member is a longitudinally extending valve member and in which the armature member may be arranged to move axially between the electromagnets.

According to a second aspect of the present invention, there is provided a two-coil solenoid valve for implementing the method according to the next five preceding paragraphs, wherein at least one electrically controllable switching means is provided for switching the electromagnets on and off.

BRIEF DESCRIPTION OF THE DRAWINGS

The foregoing and further features of the method of the present invention will be more readily understood from the following description with reference to the accompanying drawings, of which.

Figure 1:
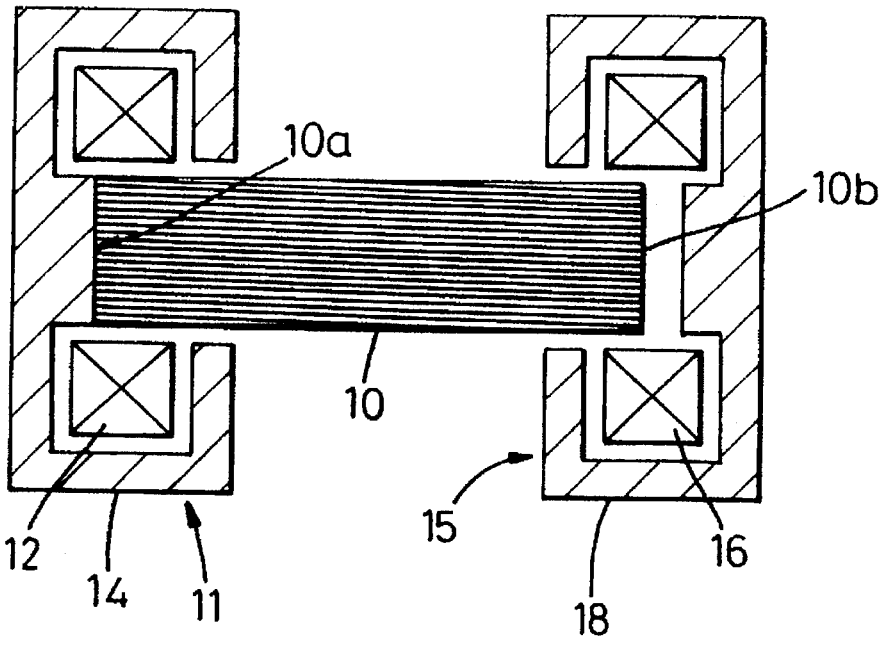
FIG. 1 is a block schematic side elevational view of a two-coil solenoid valve.

A known two-coil solenoid valve (TCV) is shown in FIG. 1. This comprises a cylindrical metallic armature member 10 mounted in a housing (not shown) for movement between a first electromagnet 11 having a coil 12 and a corresponding pole piece 14 and a second electromagnet 15 having a coil 16 and a corresponding pole piece 18. The first electromagnet 11 is located adjacent a first end 10*a* of the armature member 10 and the second electromagnet 15 is located adjacent a second end 10*b* of said member 10. The armature member 10 is mounted within the housing for axial movement between the pole pieces (14,18).

The armature member 10 has formed in its surface at least one radially extending groove (not shown) which together with co-operating channels (not shown) in the housing form a valve part of the TCV. When the groove is coincident with the co-operating channels, fluid may flow from the first channel to the second channel via the groove. Operation of the valve part is dependent on movement of the armature member bringing the groove into alignment or out of alignment with the co-operating channels as the case may be.

Movement of the armature member 10 in the known TCV can be controlled by the selective switching on of the first and second electromagnets (11,15). The armature member 10 can be caused to move from a first position with its first end 10*a* closely adjacent to the first pole piece 14 to a second position having its second end 10*b* closely adjacent to the second pole piece 18 by switching on only the second electromagnet 15. Conversely, the armature member 10 can be returned to its first position by switching on only the first electromagnet 11.

A problem is encountered with this mode of operating a TCV since there is an inherent delay between the time of switching on an electromagnet (11,15) and movement of the armature member 10 under the influence of an energised coil (12,16) of said electromagnet (11,15).

DESCRIPTION OF PREFERRED EMBODIMENTS

Any coil has resistance and inductance so that when a potential is applied to it the current through the coil obeys the relationship:

$$V = L \cdot \frac{di}{dt} + iR$$

where i is the current flowing in the coil

L is the inductance of the coil

R is the resistance of the coil and

V is the potential across the coil.

Figure 2:
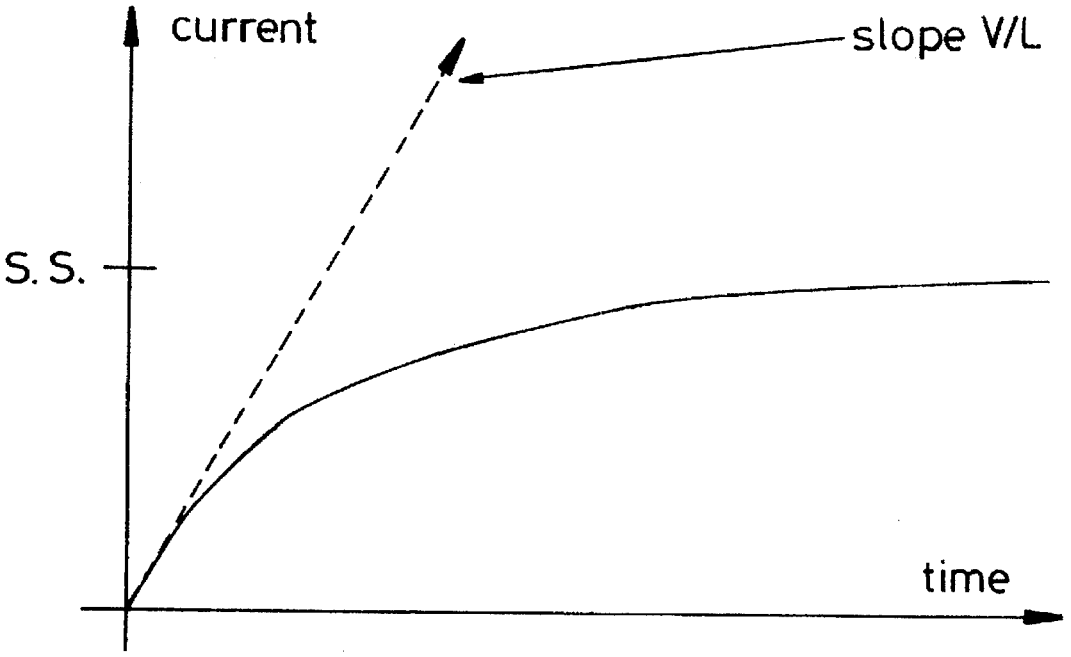
FIG. 2 is a graph illustrating current buildup in an energised coil.

This relationship is a first order differential and it can be seen from the graph of FIG. 2 that current build-up in a coil when a potential is applied thereto rises from a zero value before tailing off to a steady state (S.S.) value. The rate of build-up of current is, for a given coil, proportional to the applied potential and inversely proportional to its inductance. Because the armature member will not move until a certain current has been reached, this creates a delay between switching on of the coil and movement of the armature member. It will be appreciated that the graph of FIG. 2 is only strictly true for the period when the armature member is not moving, but the aforementioned delay will, of course, have then occurred. The existence of such a delay is generally undesirable and is, in particular, undesirable for TCVs used in an internal combustion i.c. engine whose performance is electronically controlled. To take advantage of the benefits of using electronic control of engine performance it is important that engine components react rapidly to control signals.

The delay inherent in the known TCV can be reduced by increasing the potential applied across the coil but in an i.c. engine, wherein the applied voltage is typically 12 volts, this would involve the provision of additional power supply circuitry. An alternative method of decreasing the delay would be to reduce the inductance of the coil but this would require reducing the number of turns on the coil, which would increase the current needed to move the armature member and which would, in an i.c. engine, lead to other problems in the wiring and generator set for the engine.

It can be seen from the aforementioned mathematical relationship that the rate of current build-up in an energised coil is proportional to the voltage applied and inversely proportional to the inductance of the coil. Similarly, the rate of current decrease in a coil on de-energisation is also inversely proportional to the inductance of the coil and directly proportional to the voltage occurring across the coil during current discharge. It will therefore be understood from the aforementioned mathematical relationship that, when a coil is de-energised, i.e. applied voltage is removed, if the potential occurring across the coil is allowed to rise the current decrease $$\left(\frac{di}{dt}\right)$$

can become extremely high and current discharge from the coil is rapid. The potential across the coil on de-energisation will always be limited in some way by external circuitry but even in a 12 volt i.c. engine system it may reach a level of at least 60 volts.

The device of GB 2189940A makes use of this. Movement of the armature member in this device is controlled by switching on both the first and second electromagnets simultaneously and, for movement of the armature member from a first position to a second position, subsequently switching off the first electromagnet. Movement of the armature member back to its first position may be achieved by firstly switching the first electromagnet on again and then subsequently switching off the second electromagnet. However, this method of controlling movement of the armature member has the disadvantages as hereinbefore described.

The present invention proposes a novel method of controlling movement of an armature member in a TCV. The method has two alternative forms which separately overcome the disadvantages encountered with the control method of GB 2189940A.

Figure 3:
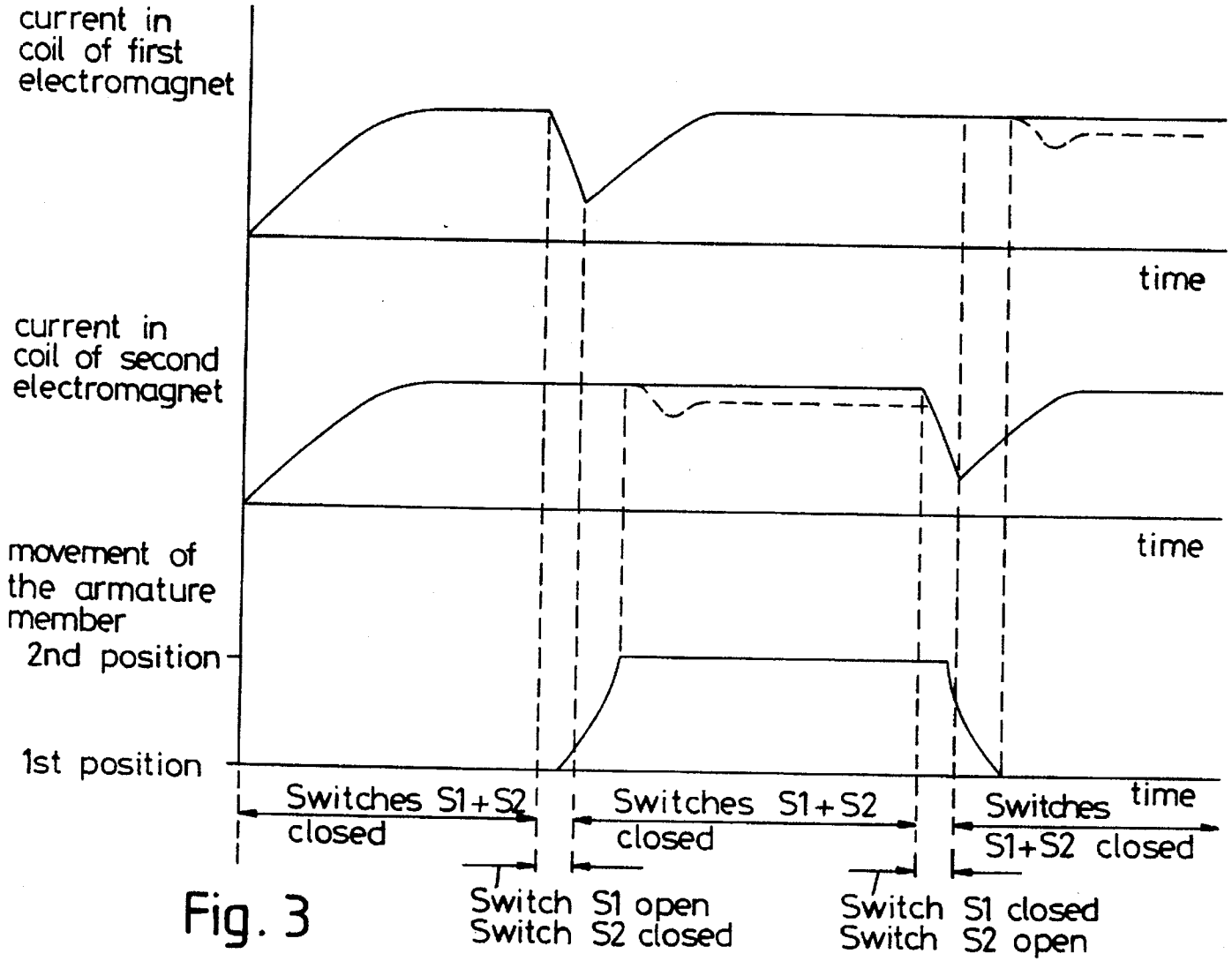
FIG. 3 shows a comparison between a current/time diagram of each electromagnet and a path/time diagram for the armature member when the electromagnets are controlled to be initially in their switched on states, and the armature member is initially at the first position.
Figure 4:
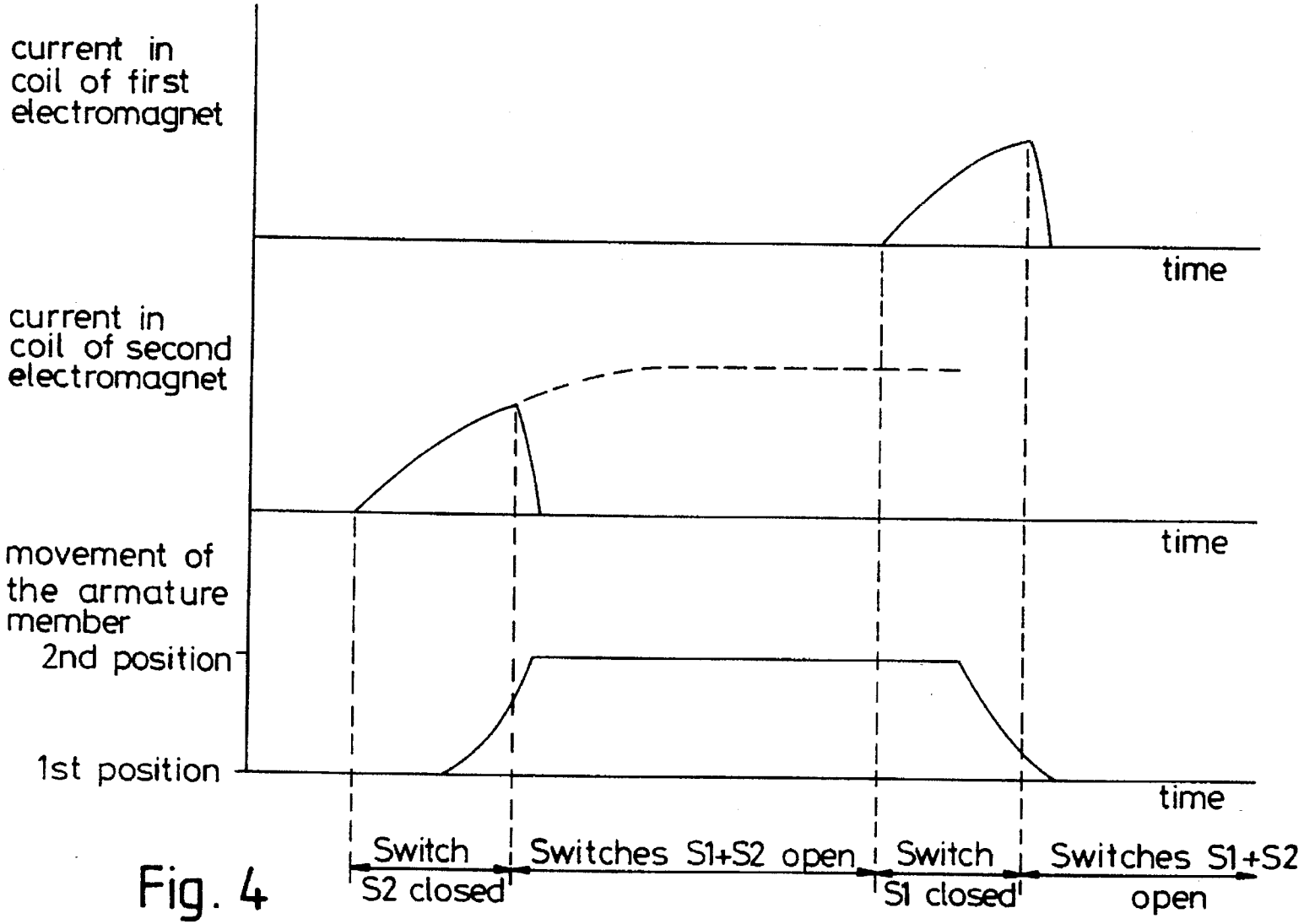
FIG. 4 shows a comparison between a current/time diagram of each electromagnet and a path/time diagram for the armature member when the electromagnets are controlled to be initially in their switched off states and the armature member is initially at the first position.

The two forms of the method of the present invention are better understood with reference to FIGS. 3 and 4, respectively.

Referring firstly to FIG. 3, there is shown a comparison of current flow in each of the coils (12,16) of the first and second electromagnets (11,15) with respect to movement of the armature member 10. This control sequence essentially comprises maintaining both electromagnets (11,15) in their switched on states continuously except for selectively switching off an appropriate one of said electromagnets (11,15) for a first predetermined period to allow the armature member 10 to move between its first and second positions.

On start-up, both electromagnets (11,15) are switched on and current in their coils (12,16) rises to a steady state value which, at least initially, is controlled to be at the same level. The armature member 10 will be held at the end of the TCV at which it was at rest prior to the switching on of the electromagnets (11,15) by virtue of the magnetic remanence (residual magnetism) of the nearest pole piece (14,18).

In the following description of the control sequence it is assumed that the armature member 10 is initially held at its first position closely adjacent to the first pole piece 14.

Both electromagnets (11,15) exert a pull on the armature member 10. However, the armature member 10 will remain in its first position since the pull exerted on it by the first electromagnet, in whose air gap it is situated, is greater than the pull exerted on it by the second electromagnet 15. Thus, the resultant pull is directed towards the first electromagnet 11. To cause the armature member to move to its second position it is necessary to cause the pull exerted on it to be reversed in direction. This is achieved in a similar manner to GB 2189940A by switching the first electromagnet 11 to its switched off state. Consequently, current in the coil 12 of the first electromagnet 11 rapidly decreases (at a rate greater than the rate of current build-up in the coil on start-up) until a point is reached where the resultant pull on the armature member 10 is directed towards the second electromagnet 15. Thus, the armature member 10 begins to travel to its second position. However, in contrast to GB 2189940A, it has been realised that there is no requirement to allow current in the coil 12 of the first electromagnet 11 to decrease to zero to enable movement of the armature member 10 to its second position. In fact, in a practical application, the armature member 10 would arrive at its second position before current in said coil 12 has completely discharged. In addition, since current build-up in the coil 12 is at a much less rapid rate than the rate of current decrease on switch off, it is possible to switch the first electromagnet 11 back to its switched on state before the armature member arrives at its second position. In this way, dead-time can, for practical purposes, be eliminated thus offering very high rates of switching speed for the TCV.

It will be appreciated that movement of the armature member from its second position back to its first position is achieved in a similar manner by a subsequent switching off of the second electromagnet 15 for a predetermined period as illustrated in FIG. 3.

A further advantage of this mode of operation is that, because the resultant pull causing movement of the armature member its second first position to its second position is effectively a product of the pull exerted by the second electromagnet 15 less the decreasing pull exerted by the first electromagnet 11, and the current in the coil 16 of the second electromagnet 15 is at its steady-state value (i.e. the coil 16 is not in the process of current build-up), movement of the armature member is more rapid than would be the case if movement was controlled in a conventional manner by separately switching on an appropriate electromagnet.

The control sequence as illustrated in FIG. 3 may be enhanced further by the step of switching the second electromagnet 15 from its switched on state to its switched off state for a second predetermined period at some time after the armature member 10 has reached its second position. At this point, the second electromagnet 15 is effectively acting as the holding electromagnet since, due to the armature member's position, it is exerting a greater pull on the armature member 10 than the first electromagnet 11, the coil 12 of which has now recharged to its initial steady-state current level. This subsequent switching of states of the second electromagnet 15 is controlled in such a manner than current flow in the coil 16 of this electromagnet 15 does not decrease to a level which allows the armature member 10 to be captured by the first electromagnet 11. However, the predetermined time is chosen such that current flowing in the coil 16 of the second electromagnet 15 decreases to a new steady-state level which is sufficient to hold the armature member 10 in its second position. Thus, when it is desired to cause the armature member 10 to return to its first position, the second electromagnet is switched to its switched off state for a third predetermined period which will be of lesser duration than the first predetermined period resulting in a more rapid response to an armature move signal.

The savings in time in using this form of operation according to the invention are relatively small in real-time terms but can be advantageous at the speeds of operation encountered in i.c. engine electronic control units, for example.

The problem of heat build-up due to the almost continuous current flow through the coils (12,16) of the TCV can be overcome by using suitable thermally conductive materials for the housing and pole pieces (14,18) and providing heat sinks in thermal communication with the exterior of the housing.

Referring now to FIG. 4, this illustrates the second form of controlling movement of the armature member in accordance with the method of the invention.

The control sequence illustrated here is essentially similar to that of a conventional control sequence for a TCV in which the first and second electromagnets are generally in their switched off states save for being switched on periodically to cause movement of the armature member. However, in a similar manner to the first form of the method in accordance with the invention, it has been appreciated that it is only necessary to switch a respective electromagnet to its switched on state for a predetermined period sufficient to cause the resultant pull exerted on the armature member 10 to cause it to move towards the second electromagnet. The second electromagnet 15 can then be switched back to its switched off state before the armature member 10 reaches said second position. The momentum gained by the armature member 10 during the period that the second electromagnet 15 exerts a pull on it is sufficient to carry it to the second position where it is captured by the remanence of the pole piece 18 and any remaining pull exerted by the second electromagnet 15 during the discharge of current in its coil 16. Movement of the armature member 10 back to its first position is achieved in a similar manner by switching on the first electromagnet 11 for a predetermined period.

This mode of operation reduces the time that the electromagnets are switched on thus reducing heat build-up in the TCV. In addition, the switching speed of the TCV can be increased over that of a TCV operated in accordance with the conventional method.

Figure 5:
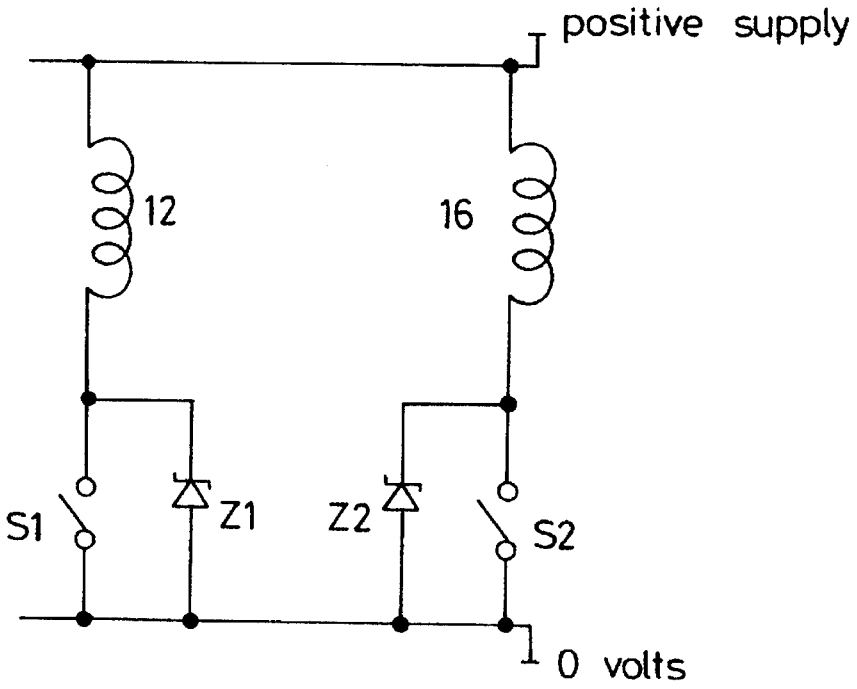
FIG. 5 shows a schematic circuit diagram of a suitable switching circuit for the electromagnets.

FIG. 5 diagrammatically illustrates a circuit suitable for controlling current flow in the coils (12,16) of the electromagnets (11, 15). It will be understood that the switches (S1,S2) can be semiconductor devices and that they can be used to regulate the current when the coils (12,16) are energised as well as switching the current on and off. The zener diodes (Z1,Z2) are included to protect the switches from inductive flyback during switch off. This, however, is a standard technique which needs no further description. The control circuit may comprise a simple circuit as suggested in FIG. 5, but preferably consists of a suitably programmed processor means. The processor means is preferably integrated within the electronic control unit (ECU) of an i.c. engine.

Motion of the armature member 10 can be detected by the potential (back e.m.f.) induced (in the coil (12,16) which is switched off) by the remanence in the magnetic circuit as the armature member 10 moves.

Figure 6:
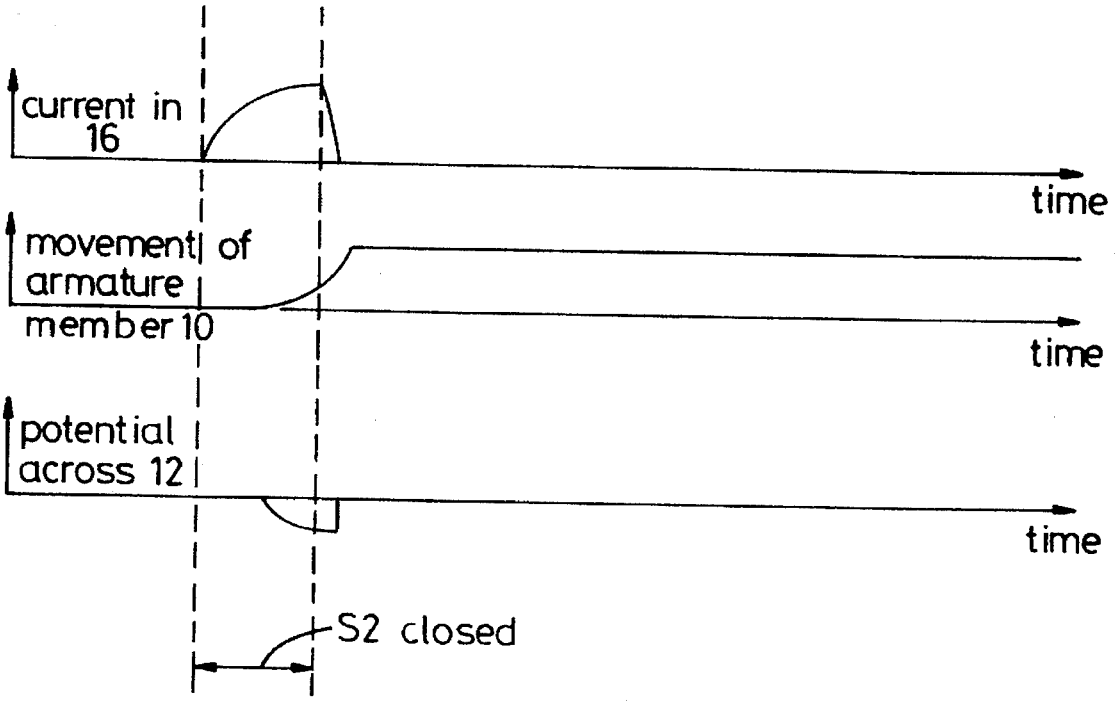
FIG. 6 shows a comparison between a current/time diagram for the second electromagnet, a path/time diagram for the armature member and an induced potential/time diagram for the first electromagnet, when the electromagnets are controlled to be initially in their switched off states.

In the case where movement of the armature member is controlled in accordance with the method illustrated in FIG. 4, when the current in coil 16 of the second electromagnet 15 is switched off the potential across coil 12 of the first electromagnet 11 is indicated in FIG. 6.

The potential across coil 12 can be detected by standard electronic techniques and therefore needs no special description.

In the case where movement of the armature member 10 is controlled in accordance with the method of GB 2189940A, the situation is complicated by the fact that the movement occurs just after one coil is switched off and the potential across that coil is set up both by the movement and the effects associated with switching off.

Figure 7:
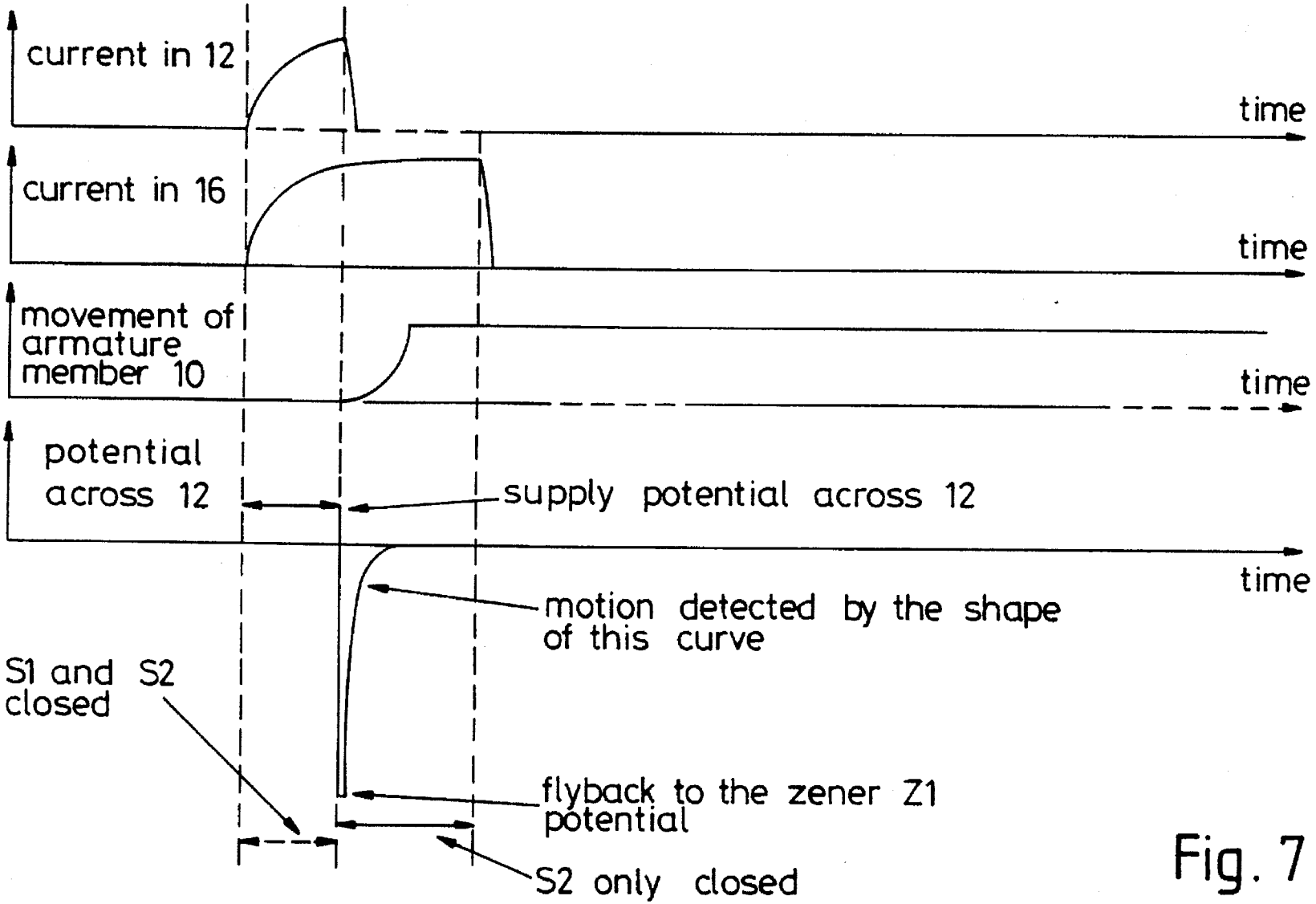
FIG. 7 shows a comparison between a current/time diagram for the first electromagnet, a current/time diagram for the second electromagnet, a path/time diagram for the armature member and an induced potential/time diagram for the first electromagnet when the electromagnets are controlled in accordance with the known method disclosed in GB 2189940A.

FIG. 7 shows the basic situation. During movement in the direction in which the coil 16 pulls, the potential across coil 12 follows the curve shown. The sections are as follows: zero potential before the switches close; battery potential while both switches are closed; the zener Z1 potential while the current in coil 12 is dropping; and a falling potential where the motion is detected.

It should be noted that if coil 12 was a pure inductance the potential would drop instantaneously when the Zener stopped conducting. The slow fall off is caused by eddy currents in the magnetic circuit and stray capacitance.

Figure 8:
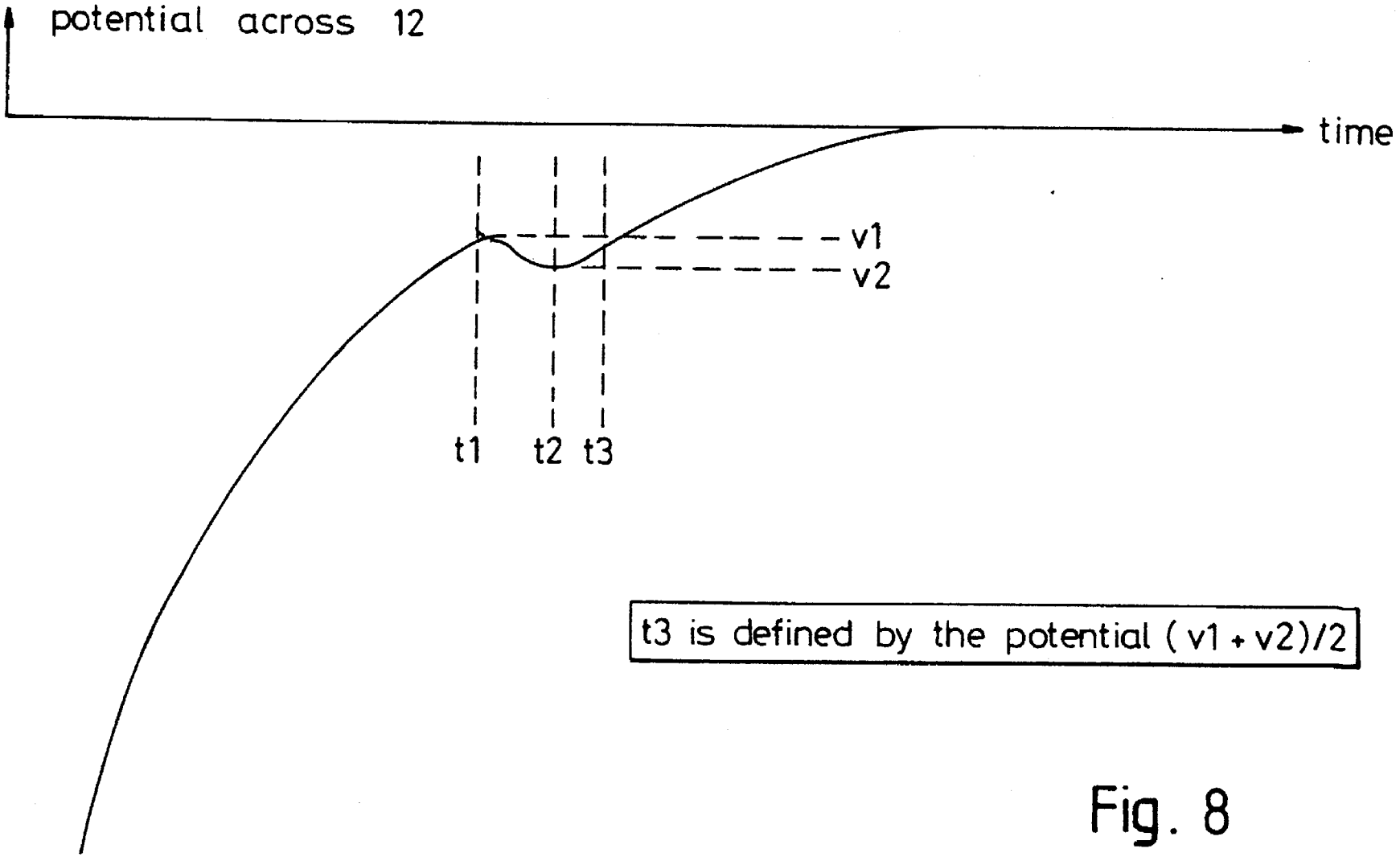
FIG. 8 shows an enlarged view of a portion of the induced potential/time diagram for the first electromagnet.

The effect of expanding the curve to show the details that are detected is shown in FIG. 8. The essential point to detect is the cusp shape, which is caused by the armature member movement, where the slope changes sign between t1 and t2. Several methods can be used to detect the cusp. The most significant are: to detect the change in the sign of the slope after t1; to detect the second zero slope at t2; and to hold the potentials at zero slope at t1 and t2 and detect when the coil potential passes the value v3 as defined in FIG. 8. All these methods use standard electronic circuit techniques.

What is claimed is:

1. A method of operating a two-coil solenoid valve having an armature member located in a housing for movement between a first electromagnet and a second electromagnet, each electromagnet being located adjacent to a respective end of said armature member and being switchable between an on state and an off state, said method comprising moving the armature member from a first position closely adjacent to the first electromagnet to a second position closely adjacent to the second electromagnet, wherein the electromagnets are controlled to be at the same initial switched state and subsequently one of said electromagnets is switched to said other switched state for a first predetermined period sufficient to allow the resultant pull exerted on the armature member to be such that the armature member is caused to move towards the second electromagnet, the duration of the first predetermined period being such that said one electromagnet is switched back to its initial switched state before the armature member reaches said second position.

2. A method as claimed in claim 1, wherein the electromagnets are controlled to be initially at their switched on states prior to being controlled to cause movement of the armature member.

3. A method as claimed in claim 2, wherein, after the armature member has reached the second position, the second electromagnet is controlled to be switched to its off state for a second predetermined period, the duration of this period being such that a steady state current flowing in a coil of the second electromagnet decreases to a lower steady state current level which is sufficient to maintain the armature member in said second position prior to a subsequent further switching off of the second electromagnet for a further predetermined period to cause movement of the armature member to the first position.

4. A method as claimed in claim 1, wherein the electromagnets are controlled to be initially at their switched off states prior to being controlled to cause movement of the armature member.

5. A method as claimed in claim 1, wherein the armature member is a longitudinally extending valve member that is moved axially between the electromagnets.

6. A two-coil solenoid valve comprising an armature member located in a housing for movement between a first electromagnet and a second electromagnet, each electromagnet being located adjacent to a respective end of said armature member and being switchable between an on state and a off state, and at least one electrically controllable switching means for switching one of said first and second electromagnets to cause said armature member to move from a first position adjacent said first electromagnet to a second position adjacent said second electromagnet, said means for switching 1) initially switching said one electromagnet from a first energization state in which it exhibits the same energization state as the other of said first and second electromagnets into a second energization state in which it exhibits an opposite energization state as the other of said first and second electromagnets, thereby to cause said armature member to move from said first position and into said second position, and 2) switching said one electromagnet back into said first energization state while said armature member is moving from said first position towards said second position and before said armature member reaches said second position, wherein said armature member continues to move towards and into said second position after said one electromagnet is switched back into said first energization state.

7. A method as claimed in claim 2, wherein the armature member is a longitudinally extending valve member that is moved axially between the electromagnets.

8. A method as claimed in claim 3, wherein the armature member is a longitudinally extending valve member that is moved axially between the electromagnets.

9. A method as claimed in claim 4, wherein the armature member is a longitudinally extending valve member that is moved axially between the electromagnets.

10. A method of operating a two-coil solenoid valve comprising: providing a two-coil solenoid valve with a housing, an armature member located in said housing, said armature member having a first end and a second end and being switchable between a first position and a second position, a first electromagnet connected to said housing, located adjacent said first end of said armature member and located closely adjacent said first position, said first electromagnet being switchable between a first electromagnet energized state and a first electromagnet deenergized state, and a second electromagnet connected to said housing, located adjacent said second end of said armature member and located closely adjacent said second position, said second electromagnet being switchable between a second electromagnet energized state and a second electromagnet deenergized state;

controlling said first electromagnet to be in said first electromagnet energized state, said second electromagnet to be in said second electromagnet energized state and said armature member to be in said first position;

switching said first electromagnet to said first electromagnet deenergized state for a first time period sufficient to allow a resultant pull exerted on said armature member by said second electromagnet to move said armature member away from said first position and into said second position; and switching said first electromagnet back to said first electromagnet energized state before said armature member reaches said second position, wherein said armature member reaches said second position after the step of switching said first electromagnet back to said first electromagnet energized state.

11. The method of claim 10 further comprising:

switching said second electromagnet to said second electromagnet deenergized state for a second time period;

switching said second electromagnet to said second electromagnet energized state before said armature member leaves said second position; and switching said second electromagnet to said second electromagnet deenergized state for a third time period that is both of lesser duration than said first time period and sufficient to allow a resultant pull exerted on said armature member by said first electromagnet to move said armature member away from said second position and toward said first position, wherein said armature member is held in said second position until said second electromagnet is switched to said second electromagnet deenergized state for said third time period.

12. The method of claim 10 wherein said armature member is a longitudinally extending valve member that moves axially between said first position and said second position.

13. The method of claim 11 wherein said armature member is a longitudinally extending valve member that is moves axially between said first position and said second position.

14. A two-coil solenoid valve comprising a housing, an armature member located in said housing, said armature member having a first end and a second end and being switchable between a first position and a second position, a first electromagnet connected to said housing, located adjacent said first end of said armature member and located closely adjacent said first position, said first electromagnet being switchable between a first electromagnet energized state and a first electromagnet deenergized state, and a second electromagnet connected to said housing, located adjacent said second end of said armature member and located closely adjacent said second position, said second electromagnet being switchable between a second electromagnet energized state and a second electromagnet deenergized state;

means for controlling i) said first electromagnet to be in said first electromagnet energized state, ii) said second electromagnet to be in said second electromagnet energized state and iii) said armature member to be in said first position;

means for switching said first electromagnet to said first electromagnet deenergized state for a first time period sufficient to allow a resultant pull exerted on said armature member by said second electromagnet to move said armature member away from said first position and into said second position; and means for switching said first electromagnet back to said first electromagnet energized state before said armature member reaches said second position.

15. A method of operating a two-coil solenoid valve comprising:

providing a two-coil solenoid valve with a housing, an armature member located in said housing, said armature member having a first end and a second end and being switchable between a first position and a second position, a first electromagnet connected to said housing, located adjacent said first end of said armature member and located closely adjacent said first position, said first electromagnet being switchable between a first electromagnet energized state and a first electromagnet deenergized state, and a second electromagnet connected to said housing, located adjacent said second end of said armature member and located closely adjacent said second position, said second electromagnet being switchable between a second electromagnet energized state and a second electromagnet deenergized state;

controlling said first electromagnet to be in said first electromagnet deenergized state, said second electromagnet to be in said second electromagnet deenergized state and said armature member to be in said first position;

switching said second electromagnet to said second electromagnet energized state for a first time period sufficient to allow a resultant pull exerted on said armature member by said second electromagnet to move said armature member away from said first position and toward said second position; and switching said second electromagnet back to said second electromagnet deenergized state before said armature member reaches said second position, wherein said armature member reaches said second position after the step of switching said first electromagnet to said first electromagnet energized state.

16. The method of claim 15 wherein said armature member is a longitudinally extending valve member that moves axially between said first position and said second position.

17. A two-coil solenoid valve comprising a housing, an armature member located in said housing, said armature member having a first end and a second end and being switchable between a first position and a second position, a first electromagnet connected to said housing, located adjacent said first end of said armature member and located closely adjacent said first position, said first electromagnet being switchable between a first electromagnet energized state and a first electromagnet deenergized state, and a second electromagnet connected to said housing, located adjacent said second end of said armature member and located closely adjacent said second position, said second electromagnet being switchable between a second electromagnet energized state and a second electromagnet deenergized state;

means for controlling i) said first electromagnet to be in said first electromagnet deenergized state, ii) said second electromagnet to be in said second electromagnet deenergized state and iii) said armature member to be in said first position;

means for switching said second electromagnet to said second electromagnet energized state for a first time period sufficient to allow a resultant pull exerted on said armature member by said second electromagnet to move said armature member away from said first position and into said second position; and means for switching said second electromagnet back to said second electromagnet deenergized state before said armature member reaches said second position.

* * * * *